US011331719B2

(12) United States Patent
Schönbrenner

(10) Patent No.: US 11,331,719 B2
(45) Date of Patent: May 17, 2022

(54) SLIDE GATE WITH COMPENSATION DEVICE FOR THE CONTACT PRESSURE

(71) Applicant: KNÖLLINGER FLO-TEC GMBH, Hillscheid (DE)

(72) Inventor: Wolfgang Schönbrenner, Kreuzau (DE)

(73) Assignee: KNÖLLINGER FLO-TEC GMBH, Hillscheid (DE)

( * ) Notice: Subject to any disclaimer, the term of this patent is extended or adjusted under 35 U.S.C. 154(b) by 68 days.

(21) Appl. No.: 16/804,697

(22) Filed: Feb. 28, 2020

(65) Prior Publication Data

US 2021/0268580 A1 Sep. 2, 2021

(51) Int. Cl.
*B22D 41/24* (2006.01)
*B22D 41/34* (2006.01)

(52) U.S. Cl.
CPC ..... *B22D 41/24* (2013.01); *B22D 41/34* (2013.01)

(58) Field of Classification Search
CPC ..... B22D 41/24; B22D 41/34; B22D 41/08; B22D 41/14
USPC ..... 222/600, 603, 606, 590; 266/236, 287, 266/271
See application file for complete search history.

(56) References Cited

U.S. PATENT DOCUMENTS 4,220,269 A 9/1980 Beckers et al.
4,253,647 A * 3/1981 Andres ..... B22D 41/26 266/287
4,603,842 A * 8/1986 King ..... F27D 3/1509 222/590
4,618,126 A * 10/1986 Tinnes ..... B22D 41/26 266/271
4,728,014 A * 3/1988 Keller ..... B22D 41/40 222/600
4,953,760 A * 9/1990 Foglio ..... B22D 41/40 222/600

(Continued)

FOREIGN PATENT DOCUMENTS

DE 1 299 804 B 7/1969
DE 2736817 B1 11/1978

(Continued)

OTHER PUBLICATIONS

Oct. 22, 2018 Communication issued in European Application 18191433.4.

*Primary Examiner* — Scott R Kastler
*Assistant Examiner* — Michael Aboagye
(74) *Attorney, Agent, or Firm* — Oliff PLC

(57) ABSTRACT

Slide gate for a metallurgical vessel, in particular a ladle, including a slide gate housing attachable to a metallurgical vessel, a head plate accommodated in the slide gate housing and having a passage opening for a metallic melt, a slide frame mounted in the slide gate housing so as to be displaceable in a direction relative to the head plate, and a slide plate accommodated in the slide frame and having a passage opening, characterized in that a device for compensating the contact pressure of the slide plate against the head plate is arranged between the slide gate housing and the slide frame, wherein the compensating device includes at least one carrier body mounted in the slide gate housing so as to be rotatable about at least one axis of rotation, and at least one spring element, via which the carrier body is coupled to the slide frame.

20 Claims, 12 Drawing Sheets

(56) References Cited

U.S. PATENT DOCUMENTS

| | | | | |
|---|---|---|---|---|
| 5,110,018 | A | 5/1992 | Lothmann et al. | |
| 7,648,053 | B2 * | 1/2010 | Rose | B22D 41/24 222/594 |

FOREIGN PATENT DOCUMENTS

| | | | |
|---|---|---|---|
| DE | 35 00 864 | C1 | 10/1985 |
| DE | 35 12 799 | C1 | 2/1986 |
| EP | 0444411 | A1 | 9/1991 |

* cited by examiner

SLIDE GATE WITH COMPENSATION DEVICE FOR THE CONTACT PRESSURE

The invention relates to a slide gate for a metallurgical vessel.

Slide gates for metallurgical vessels are known per se from the prior art. Such slide gates are typically attached to a metallurgical vessel and are used for the controlled pouring of molten metals from a spout, wherein a spout channel can be opened or closed by refractory plates that can be moved towards each other. Such slide gates are called ladle gate valves, for example. Often a slide plate is arranged within a slide frame, which is linearly movable relative to the housing of the slide gate by means of a hydraulic cylinder. With two-plate slide gates, the slide plate can be moved in relation to a fixed head plate. With three-plate slide gates, the slide plate can be moved relative to the fixed upper head plate and a fixed lower spout plate.

In order to ensure the tightness of the slide gate against uncontrolled discharge of the metallic melt, the refractory plates of the slide gate are usually pressed together in the direction of the metallurgical vessel. From the prior art it is basically known that this contact pressure of the slide plate to the head plate is applied by springs. In the prior art, the springs are often supported in the housing of the slide gate and on an underside of the slide frame, or in the slide frame and an underside of the slide plate.

From DE 27 36 817 B1 a slide gate with two independently pivot-mounted lever arms is known. A rocker frame with a roller guide for the slide housing with the slide plate arranged therein is pivotally mounted in the lever arms. At the ends of the lever arms, pressure sleeves with disc springs are attached to a transverse strut, wherein the pressure sleeves exert a pressing force on the slide plate against the head plate.

From EP 0 444 411 A1 a closing device for a pouring ladle with a pivot-mounted housing for a frame of the slide plate is known. Pressure springs are supported in the frame and exert a pressure force on the slide plate that is directed upwards towards the head plate.

Manufacturing inaccuracies, thermal deformations or an inclined installation of the refractory plates can cause an unevenly distributed contact pressure and thus a leakage of the slide gate and/or an uneven wear of the refractory plates. In addition, one or more springs may fail during casting. The failure can be caused by particularly high temperatures, fatigue or other overloads. In these cases, the contact pressure exerted on the refractory plates is no longer evenly distributed. The problems described below can also occur when using fatigued springs with lower spring stiffness and already replaced new springs with higher spring stiffness. On the one hand, liquid metal can penetrate between the plates. This reduces the durability of the refractory plates, which have to be replaced earlier than normal due to the steel inserts and the wear and tear they cause. On the other hand, there is a risk that liquid metal will leak in an uncontrolled manner between the plates and the slide gate will no longer be able to fulfil its function. In this situation the safety of the casting machine and the operating personnel may be endangered.

Prior art solutions do not sufficiently solve the problems mentioned with regard to compensation of the contact pressure.

The present invention therefore has the object of providing a slide gate which can be operated reliably and safely. In particular, the aim is to ensure that the contact pressure between the plates of the slide gate is as even as possible, especially in the event of failure of individual springs.

This object is solved by a slide gate according to at least one disclosed embodiment.

In particular, the object is solved by a slide gate for a metallurgical vessel, in particular a ladle, comprising

- a slide gate housing which can be attached to a metallurgical vessel,
- a head plate, which is accommodated in the slide gate housing and has a passage opening for a metallic melt,
- a slide frame which is mounted in the slide gate housing so as to be displaceable in a displacement direction relative to the head plate, and
- a slide plate, which is accommodated in the slide frame and has a passage opening, characterized in that a compensating device is arranged between the slide gate housing and the slide frame for compensating the contact pressure of the slide plate against the head plate, wherein the compensating device comprises

- at least one carrier body, which is mounted in the slide gate housing so as to be rotatable about at least one axis of rotation, and
- at least one spring element via which the carrier body is coupled to the slide frame.

The slide gate housing can preferably be opened and closed, e.g. by a pivoting movement, and can preferably be attached to a metallurgical vessel, in particular to its underside. The slide frame is preferably guided in the slide gate housing along the intended sliding direction. In particular, the slide gate housing is constructed in several parts, wherein a first housing part, e.g. a slide gate housing, can be movable, in particular pivotable, in relation to a second housing part, e.g. a mounting plate. Preferably, the head plate is fixed relative to a metallurgical vessel, while the slide plate is movable relative to the head plate, especially when the slide gate is closed. The head plate and the slide plate are inserted and interchangeably fastened to the slide gate housing or the slide frame, respectively, especially in plate receptacles. The sliding direction of the slide frame preferably extends in a longitudinal direction of the slide gate, wherein the slide frame could also be mounted slidably in more than one sliding direction, in particular parallel to a plane in which the head plate extends, for example by a combined transverse and rotational movement. In particular, the slide frame is mounted so as to be sufficiently movable in a direction towards or away from the metallurgical vessel to permit movement of the slide plate and the head plate towards each other for the purpose of pressing them together. The slide gate may be designed as a two-plate slide gate with a head plate and a slide plate or as a three-plate slide gate with an additional spout plate, which may be located, for example, below the slide plate, preferably stationary. The slide frame is preferably moved by a sliding device, such as a hydraulic cylinder, to actuate the slide gate.

According to the invention, a compensating device may be arranged on a side of the slide frame facing towards and/or away from the metallic vessel, i.e. on both sides or only on one side, in particular above and/or below the slide frame, preferably inside the slide gate housing. According to the invention, the compensating device can also be located between the slide gate housing and the slide frame in such a way that parts of the compensating device are located or extend outside the slide gate housing, e.g. carrier arms. For example, parts of the carrier bodies, e.g. pressure bars or carrier webs, may extend into an area outside the slide gate housing or project beyond the slide gate housing.

In one embodiment, the slide gate according to the invention is designed as a three-plate slide gate, with a spout plate being arranged between the compensating device and the slide frame.

The compensation of the contact pressure can be achieved by pressing the slide plate on one side against the head plate. In the case of a three-plate slide gate, the spout plate is pressed against the slide plate, which in turn is supported against the head plate. In particular, the plates can be pressed or pulled towards each other, especially by compression springs or tension springs. Preferably, the slide plate is pressed or pulled against the head plate, preferably towards a metallurgical vessel, i.e. in particular pressed from below or pulled from above. According to the invention, compensating (balancing) the contact pressure can be understood as the creation of a contact pressure or contact force that is as evenly distributed as possible along a contact surface between the slide plate and the head plate. In this respect, the function of the compensating device is to compensate for an uneven distribution of contact pressure between different areas of the contact surface between the slide plate and the head plate. The compensating device may be designed to compensate the contact pressure between different sides, for example longitudinal and/or transverse sides, the head plate and/or the slide plate. A balanced contact pressure does not necessarily mean a completely even contact pressure over the entire contact surface of the head plate and the slide plate. The invention makes it possible to achieve that the contact pressure is only balanced or equalized to a certain extent, especially between different sides of the head plate and/or the slide plate. One or more carrier bodies can be mounted so as to be rotatable about several axes of rotation, for example by means of a cardanic bearing, wherein in particular several carrier bodies have at least one common axis of rotation. In one possible embodiment, the carrier bodies are mounted in the slide gate housing so as to be rotatable about two, preferably common, axes of rotation extending at right angles to each other, in particular by means of a cardanic bearing.

According to the invention, a spring element can be understood as an elastic element that can apply a contact pressure to press the slide plate against the head plate. The carrier body can be coupled to the slide frame directly or indirectly via a spring element. A coupling can be understood as a mechanical coupling by the action of spring forces, wherein the carrier body and the slide frame do not have to be connected to each other, but in particular only rest on a spring element or on each other. In the case of direct coupling, at least one spring element is arranged between the carrier body and the slide frame, wherein in particular a contact pressure force is transmittable from the carrier body to the slide frame through the spring element. In the case of indirect coupling, the compensating device comprises at least one spring element, wherein a contact pressure force can be transmitted from the carrier body to the slide frame, i.e. in particular without a spring element interposed between a carrier body and the slide frame, wherein the transmitted contact pressure force is influenced or determined by the spring elements. Preferably, at least two carrier bodies are coupled to each other via at least one spring element, which is interposed in particular between the carrier bodies, wherein a contact pressure force is transmittable from the carrier body to the slide frame. The contact pressure is transferred to the slide plate in particular by the slide frame. Preferably, the compensating device is designed symmetrically to at least one axis of rotation, in particular to an axis of rotation parallel to the displacement direction of the slide frame. In particular, the rotational position of a carrier body of the compensating device is adjusted due to a moment equilibrium around an axis of rotation in such a way that the distribution of the contact pressure applied by the spring element or the contact pressure between the slide plate and the head plate is at least partially compensated locally.

The advantage of a slide gate according to the invention with a compensating device is that the contact pressure of the slide plate against the head plate is compensated (balanced) between different areas of the contact surface of the two plates, especially between a first and second side of the slide or head plate. This increases the tightness of the slide gate and achieves a uniform wear of the plates. Manufacturing tolerances of the plates or inaccuracies in the installation of the plates can be compensated. Even in the event of failure or damage to a spring element of the slide gate, the contact pressure remains as even as possible. All in all, the slide gate according to the invention can be operated more reliably and safely.

In an advantageous further development of the invention, the slide gate housing comprises a mounting plate for fixing the slide gate to a metallurgical vessel and a slide housing for guiding the slide frame, wherein the slide housing is connected to the mounting plate, in particular pivotably, and the compensating device is arranged between the slide housing and the slide frame. In particular, the slide housing and the mounting plate are designed as a first and second housing part of the slide gate housing respectively, which can be pivoted against each other, in particular about a pivot axis, to open or close the slide gate. In particular, the compensating device may be located between the mounting plate and the slide frame or between the slide housing and the slide frame, especially above or below the slide frame. In particular, the spring elements can act as tension springs or compression springs. Preferably, the compensating device is located inside the slide housing, especially on a side of the slide frame facing away from a metallurgical vessel.

In an advantageous further development of the invention, the slide frame rests on the carrier body, preferably in a sliding manner. Alternatively, the slide frame can also rest on the carrier body in a rolling manner. In particular, the slide frame is guided by the slide housing in the sliding direction, wherein the slide frame is fixed in a transverse direction to the sliding direction and is movable in the sliding direction by the sliding device. For example, a slide and/or roller guide is provided for the slide frame. The underside of the slide frame, or at least one sliding body attached to it, may have a sliding coating. According to the invention, bearing can be understood as a contact between a lower side of the slide frame and an upper side of the carrier body due to the contact pressure exerted by the carrier body on the slide frame, or vice versa. In particular, the at least one carrier body is displaceable in a direction perpendicular to an axis of rotation of the carrier body relative to the slide frame, in particular along its underside, in particular by sliding or rolling, e.g. by interposed rollers. In this way, rotation of the carrier body about its axis of rotation relative to the slide frame is permitted, while contact for transmission maintains a contact pressure from the carrier body to the slide frame. A design with a slide frame resting on top is simple and reliable, as there are no moving parts.

In an advantageous further development of the invention, an axis of rotation of the carrier body extends parallel to the displacement direction of the slide frame. This enables the pressure between two sides of the head or slide plate to be compensated at right angles to the sliding direction of the slide frame. Alternatively or in addition, the carrier body may be mounted so as to be rotatable about at least one further axis of rotation, e.g. perpendicular to the displacement direction, in order also to allow compensation of the contact pressure between two sides of the head or slide plate along the displacement direction of the slide frame. For example, a cardanic bearing of the carrier body around two axes of rotation can be provided. Preferably, the carrier body is mounted in the slide gate housing so as to be rotatable about exactly one axis of rotation, which preferably extends parallel to the displacement direction of the slide frame, especially in the longitudinal direction of the slide gate.

In an advantageous further development of the invention, the carrier body has a pressure bar which is mounted in an articulated manner on or in the carrier body, wherein the carrier body especially comprises bearing surfaces for the pressure bar which are preferably formed in a rounded or crowned manner. Such bearing surfaces are especially formed at the ends of carrier arms of the carrier body. The pressure bar is preferably mounted on or rests on the carrier body so that it can rotate or pivot about its longitudinal axis, which in particular extends parallel to the axis of rotation of the carrier body. In particular, the pressure bar rolls on the bearing surface when the carrier body is rotated. In particular, the pressure bar is suspended between two carrier arms of the carrier body. The pressure bar is fixed in particular by a cross-sectional recess in the direction of its longitudinal axis in the carrier body, especially between two carrier arms. A pressure bar ensures that the slide frame rests in a defined manner, preferably flat, on the pressure bar, in particular its top side, when the carrier body is rotated, while the resulting relative movement between the carrier body and the slide frame is compensated by the articulated mounting of the pressure bar on the carrier body. In this way, a sliding surface is functionally decoupled from a supporting surface or a rolling surface to compensate for the relative movement between the carrier body and the slide frame. In this way, the contact pressure can be transferred from the carrier body to the slide frame, while defined sliding properties are maintained between the slide frame and the carrier body.

In an advantageous further development of the invention, a sliding strip for supporting the slide frame, preferably with a sliding coating, is accommodated in the pressure bar, in particular in a form-locking manner. In particular, the sliding strip is inserted or pushed into a preferably undercut, e.g. dovetailed, rail in the pressure bar, wherein the sliding strip is preferably axially secured by flat pieces attached to the pressure bar. In particular, the sliding strip is shorter and/or narrower than the pressure bar. It preferably has a sliding coating on its upper side, which reduces the friction between a lower side of the slide frame and the carrier body, i.e. the sliding strip, when the slide frame is moved and/or the carrier body is twisted.

In an advantageous further development of the invention, the carrier body comprises two carrier arms and a carrier web connecting the carrier arms to each other, wherein the carrier web preferably has lateral pins and is in particular suspended between the carrier arms. The pins protrude in particular at the ends beyond the carrier web. Similar to the pressure bar, the carrier web can be fixed in the longitudinal direction in the carrier body by a cross-sectional recess. A carrier body with two carrier arms, a carrier web and a pressure bar forms in particular a, preferably closed, carrier frame.

In an advantageous further development of the invention, the compensating device comprises at least one pair of carrier bodies rotatably mounted in the slide gate housing, wherein in particular a first side of the slide frame rests on a first carrier body and a second side of the slide frame rests on a second carrier body. Several pairs of carrier bodies can, for example, be arranged along a common axis of rotation, especially along the displacement direction of the slide frame. This could improve the effect of the compensating device for different sections of the slide frame or the slide and/or head plate. In particular, a pair of carrier bodies rotatably mounted in the slide gate housing forms a double rocker, the carrier bodies of which are arranged so that they can be rotated in particular crosswise relative to each other. Preferably, the two carrier bodies of a pair are coupled together, thus enabling the transmission of contact pressure from one side to a second side of the slide frame.

In an advantageous further development of the invention, the carrier bodies, in particular a first and a second carrier body, are coupled together by spring elements. The spring elements include for example coil springs, disc springs or thermodynamic spring elements. Furthermore, the spring elements can include combinations of mechanical and thermodynamic springs. Preferably, the spring elements are pretensioned in the installed state. Thermodynamic springs can show an increase in spring stiffness with rising temperatures. In particular, at least one spring element is interposed or arranged between the first and the second carrier body. By arranging the carrier bodies in pairs, especially a mutual coupling of the carrier bodies via spring elements is easily achieved. This creates a self-contained compensating device which can be installed and removed in the slide gate housing including the spring elements.

In an advantageous further development of the invention, the spring elements are supported in each case in the carrier web of the first or second carrier body and the pressure bar associated with the second or first carrier body, in particular in spring recesses formed in the carrier web. This allows a spring force to be transferred from the carrier web of the first carrier body to the pressure bar of the second carrier body and further to a second side of the slide frame. Conversely, a spring force can be transmitted from the carrier web of the second carrier body to the pressure bar of the first carrier body and further to a first side of the slide frame. The carrier bodies each act like a rocker to balance the contact pressure forces between the two sides of the slide frame. As an alternative or in addition, spring elements could also be supported within carrier arms of both carrier bodies.

In an advantageous further development of the invention, a first carrier body and a second carrier body are mounted around a common axis of rotation in the slide housing. Preferably two separate axes, e.g. axle bolts, are provided, each of which is connected in particular to a carrier arm and is rotatably mounted in a bearing block which is firmly connected to the slide gate housing.

In an advantageous further development of the invention, the axis of rotation of the carrier body is parallel to a central axis of the head plate. This allows the contact forces between two sides of the slide plate to be compensated as precisely as possible, ideally perfectly.

In an advantageous further development of the invention, the carrier web is mounted in the carrier body, in particular between two carrier arms, so as to be rotatable and/or tiltable, in particular by means of lateral pins with at least partially rounded and/or beveled profiles. The pins protrude in particular at the ends beyond the carrier web. Preferably, the carrier arms have recesses adapted to the shape of the pins, into which the pins of the carrier web can be inserted. In particular, the carrier web can be rotated about a longitudinal axis parallel to the axis of rotation of the carrier body and/or tilted about a transverse axis. If the carrier body is designed in such a way that rotation of the carrier web is permitted, it can be ensured that the spring elements mounted in the carrier web are only loaded axially. If the carrier body is designed in such a way that tilting of the carrier web is permitted, wherein tilting of the pressure bar may also be provided for, the carrier arms of a carrier body can rotate independently of each other, at least over a certain angular range. This allows a better compensation of the contact pressure in the direction of the axis of rotation of the carrier body, i.e. especially in the longitudinal direction of the slide gate. In particular, it may happen that the head plate is inserted at an angle in the longitudinal direction of the slide gate. Tiltability can be used to avoid tensions within the carrier body of the compensating device.

In an advantageous further development of the invention, the first carrier body, in particular the first carrier arms, are arranged inside in the direction of the axis of rotation with respect to the head plate and the second carrier body, in particular the second carrier arms, are arranged outside. In particular, the first and second carrier bodies are arranged in a nested or interlocked manner with each other. A compensating device with such a design is particularly space-saving, especially narrow. In such a design, a compensating device can be designed to be particularly space-saving, especially narrow.

In an advantageous further development of the invention, the same number and/or type of spring elements is arranged on both sides of the compensating device, in particular in both carrier webs. This places a symmetrical load on the compensating device. Four spring elements of the same type, preferably thermodynamic spring elements, are preferably provided on both sides. Preferably, the spring elements used have the same spring stiffness. However, it is also possible to combine different spring elements with each other, for example to achieve a desired overall spring characteristic curve, or to use a different number of spring elements on each side. In particular, the spring elements are connected in parallel to each other. In particular, the compensating device according to the invention ensures that the contact pressure between two sides of the head or slide plate is still compensated for even if one or more spring elements fail.

In an advantageous further development of the invention, a sliding device, in particular an intermediate piece or a piston rod of a hydraulic cylinder, is rotatably connectable to the slide frame for displacing the slide frame in the displacement direction. As a result, even in an operating state in which the slide frame is connected to the sliding device, the slide frame can twist, especially following the twist of the compensating device, in order to allow the slide plate to be pressed evenly against the head plate. In addition, a (slight) displaceability of the slide frame towards the metallurgical vessel or the head plate may be permitted.

Embodiment examples of the invention are explained in more detail below using the drawings, wherein:

In the following description of the invention, the same reference numerals are used for identical and similarly acting elements.

FIGS. 1 to 5 show an embodiment of a slide gate according to the invention, wherein slide gate 1 in FIG. 1 is open and is shown in FIGS. 2 to 5 in the closed state.

Figure 1:
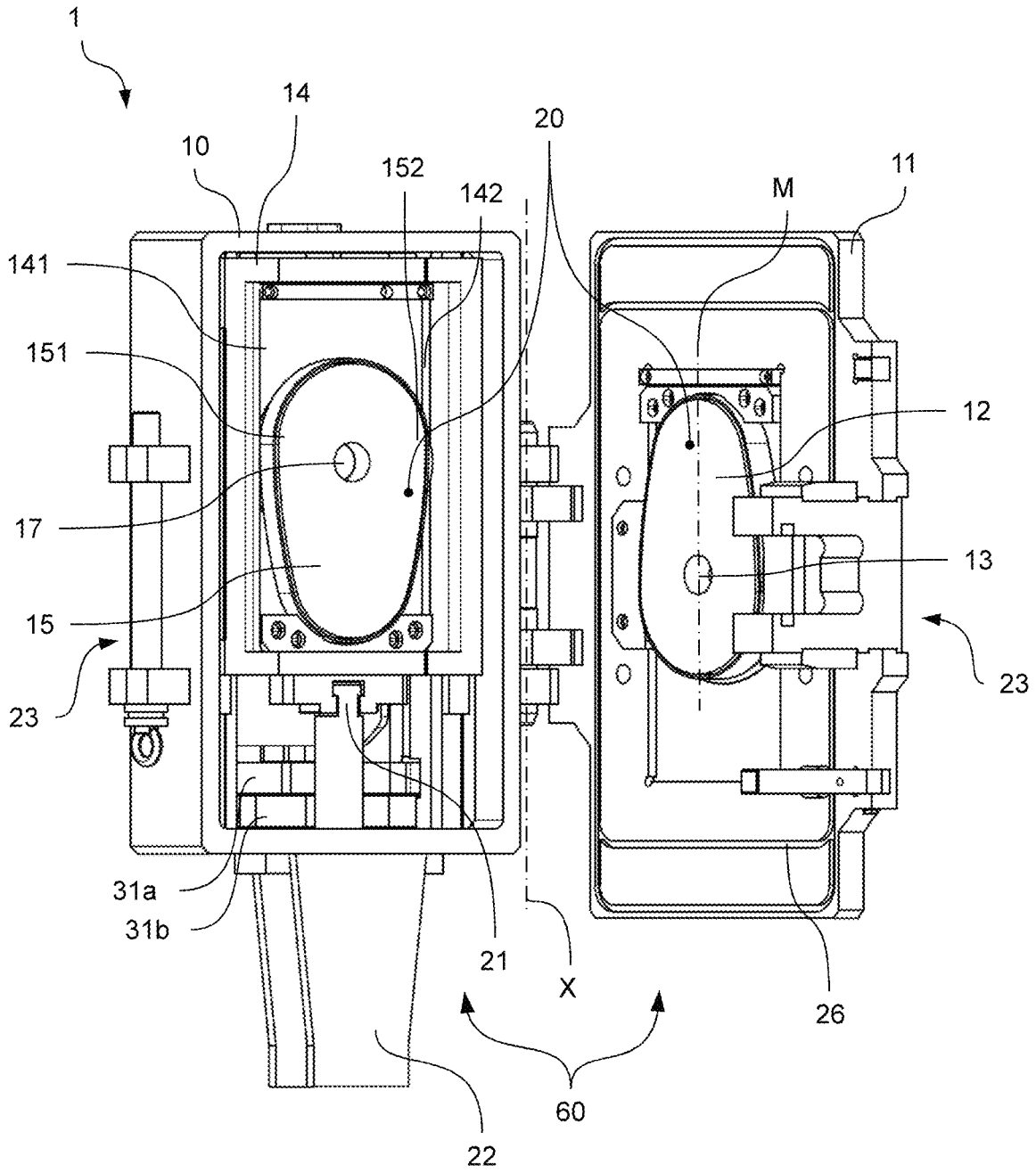
FIG. 1 shows a schematic representation of an embodiment of a slide gate in accordance with the invention in a perspective view with the slide gate open.
Figure 2:
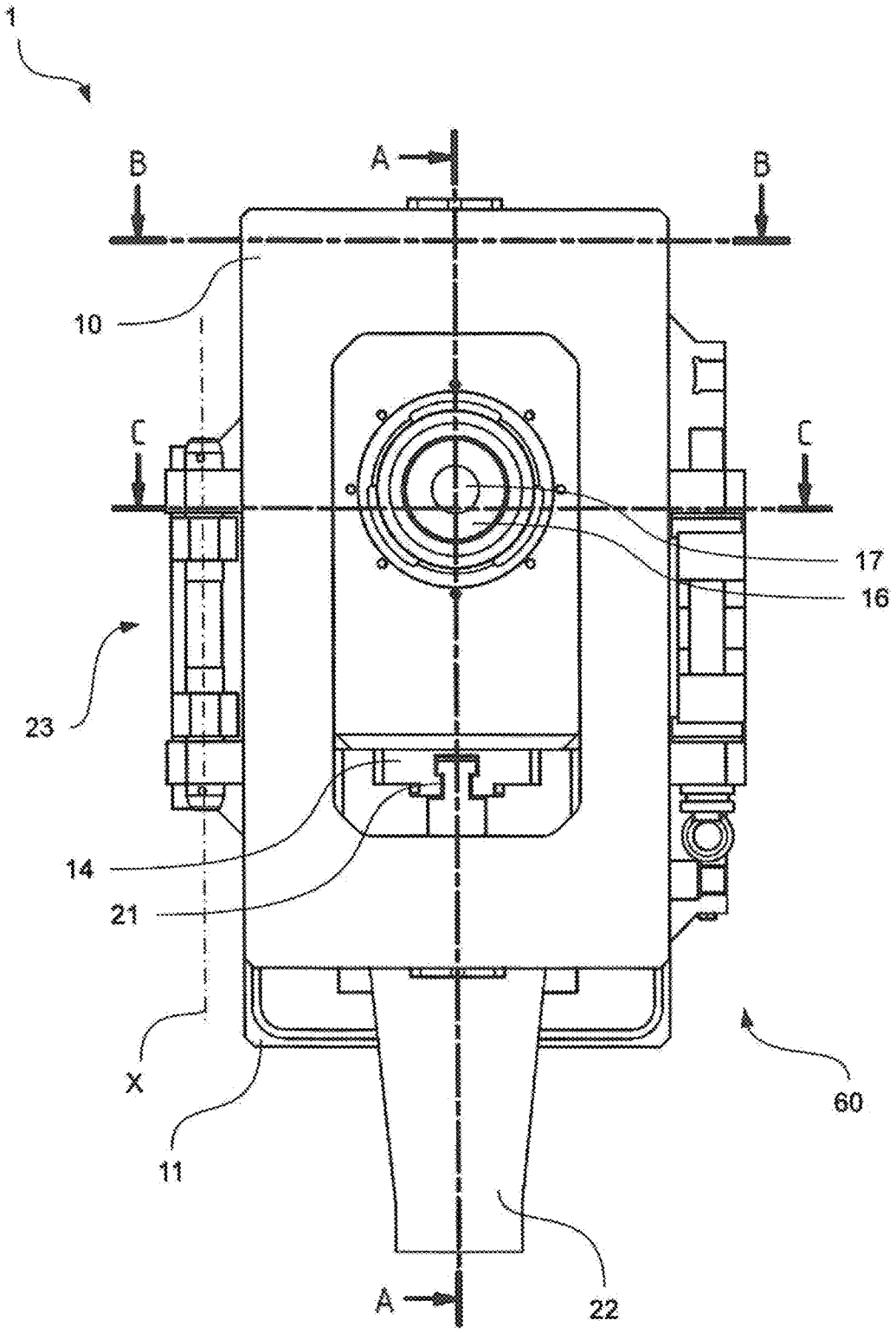
FIG. 2 shows a schematic representation of the embodiment as shown in FIG. 1 in a front view, with the slide gate closed.

Slide gate 1 can be connected to a metallurgical vessel (not shown) and can be permanently mounted on the vessel, typically on its bottom or side, e.g. as a converter slide gate. Such a vessel is suitable for holding a metallic melt, i.e. a molten metal alloy such as liquid steel, ready for a casting process. The slide gate 1 serves to close or open an opening of the metallurgical vessel in order to allow liquid metal or a metal alloy to flow out of the vessel in a controlled manner. Slide gate 1 can be locked for the operating state via a locking mechanism 23.

In the following, the terms "bottom" and "top" refer to an orientation of the assembled slide gate 1 in the state of use, in which the slide gate 1 extends in a horizontal direction, for example, so that gravity acts in a vertical direction away from the metallurgical vessel from top to bottom. In this respect, the mounting plate 11 is located at the top and the slide housing 10 at the bottom. However, the orientation of the slide gate 1 in the state of use is not limited to a horizontal orientation and can in particular also be vertical.

Slide gate 1 has a slide gate housing 60, which here comprises two housing parts in the form of a mounting plate 11 and the slide housing 10, which can be pivoted against each other about the pivot axis X. The mounting plate 11 is used for the firm connection of the slide gate 1 with the vessel and, when mounted, forms an upper cover of the slide gate housing 60. A seal 26, e.g. as a sealing cord in a circumferential sealing groove, is provided for sealing. The slide gate 1 has a head plate 12 with a central axis M, which is accommodated in the mounting plate 11 or firmly connected to it. The mounting plate 11 has a wear ring 27 located in an opening and the head plate 12 has a passage opening 13 to allow liquid metal to drain from a drain hole of the tank.

Figure 3:
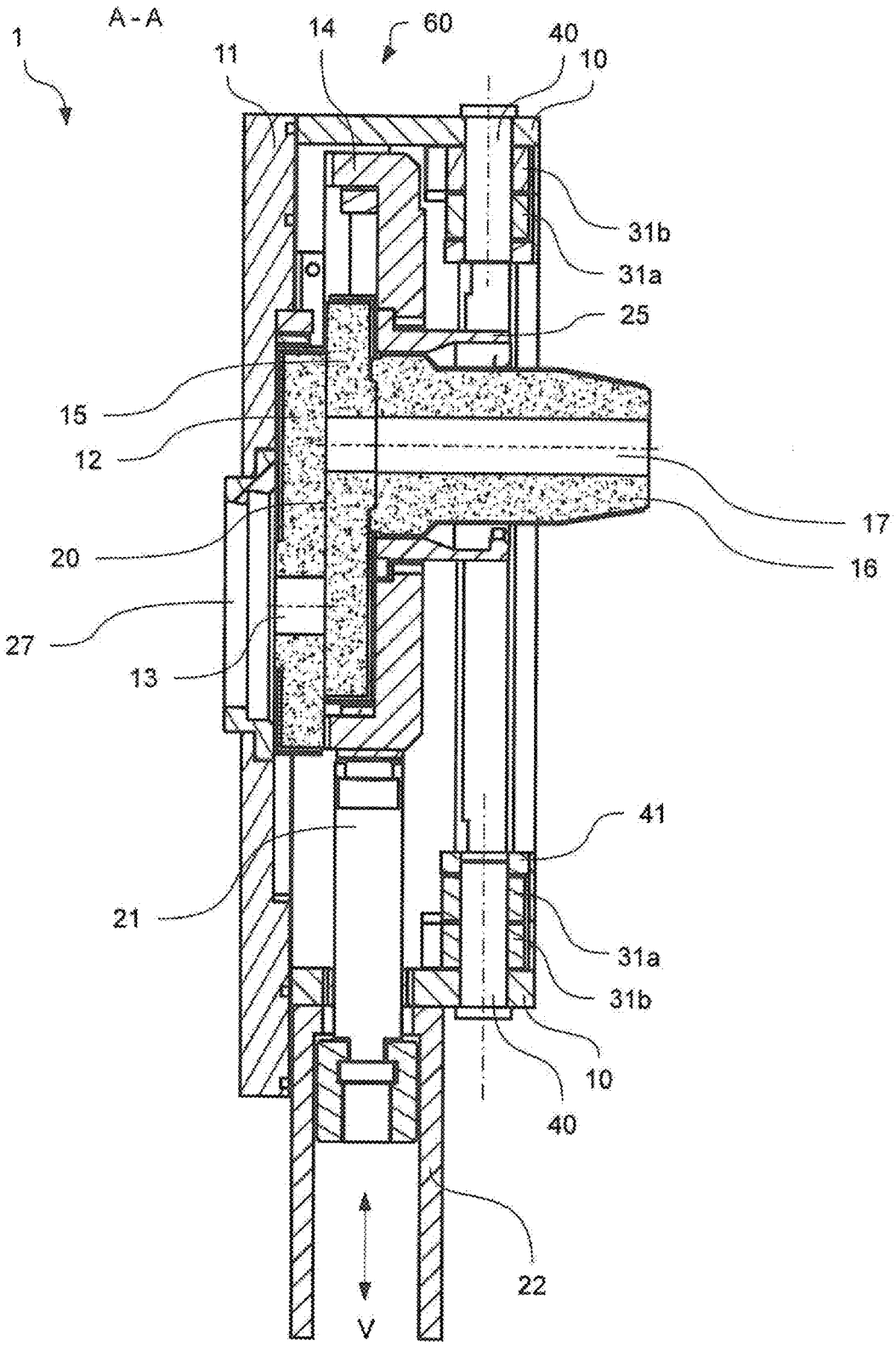
FIG. 3 shows a schematic representation of the embodiment according to FIG. 1 in a sectional side view along the line A-A in FIG. 2.
Figure 4:
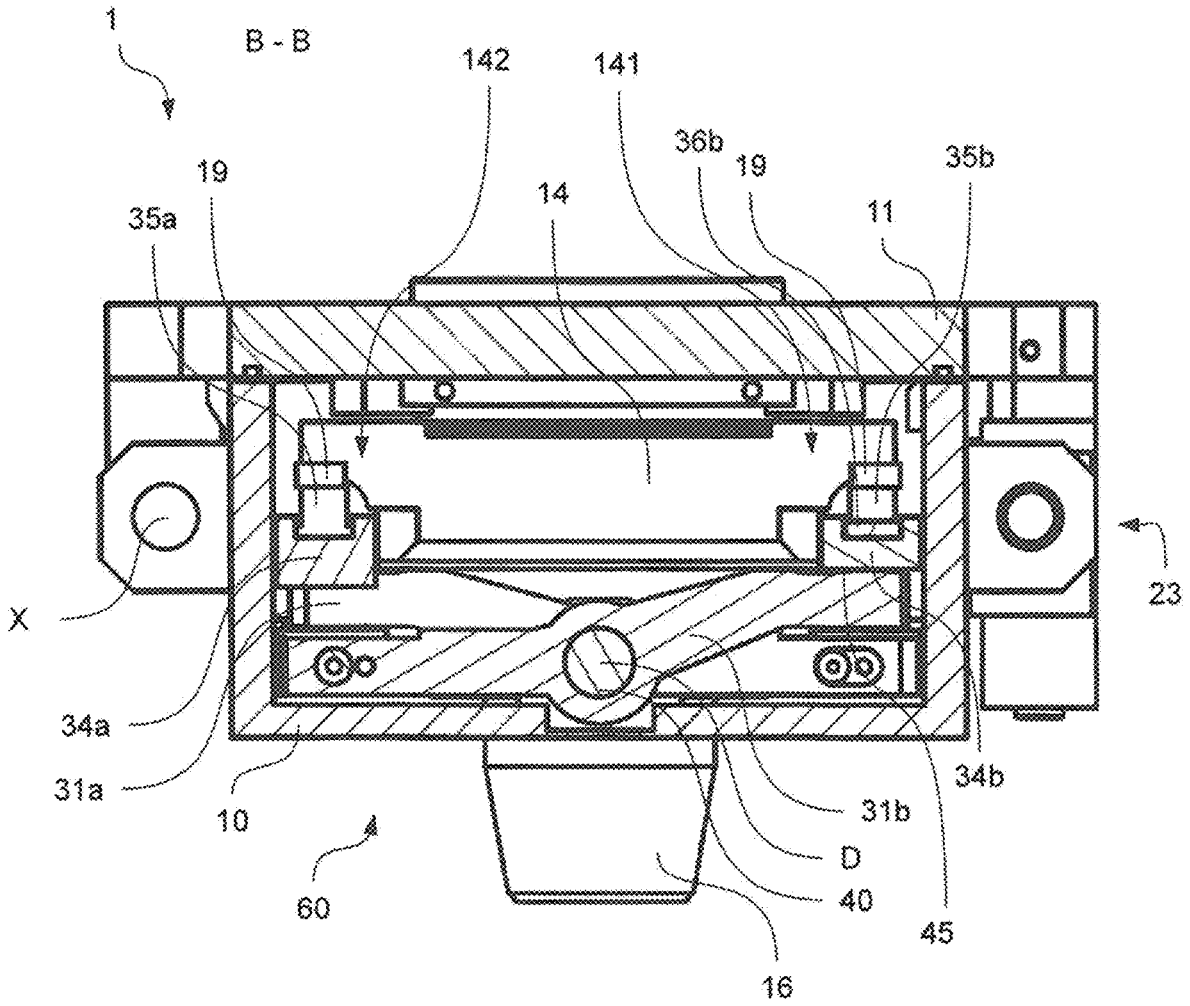
FIG. 4 shows a schematic representation of the embodiment as shown in FIG. 1 in a sectional plan view along the line B-B in FIG. 2.
Figure 5:
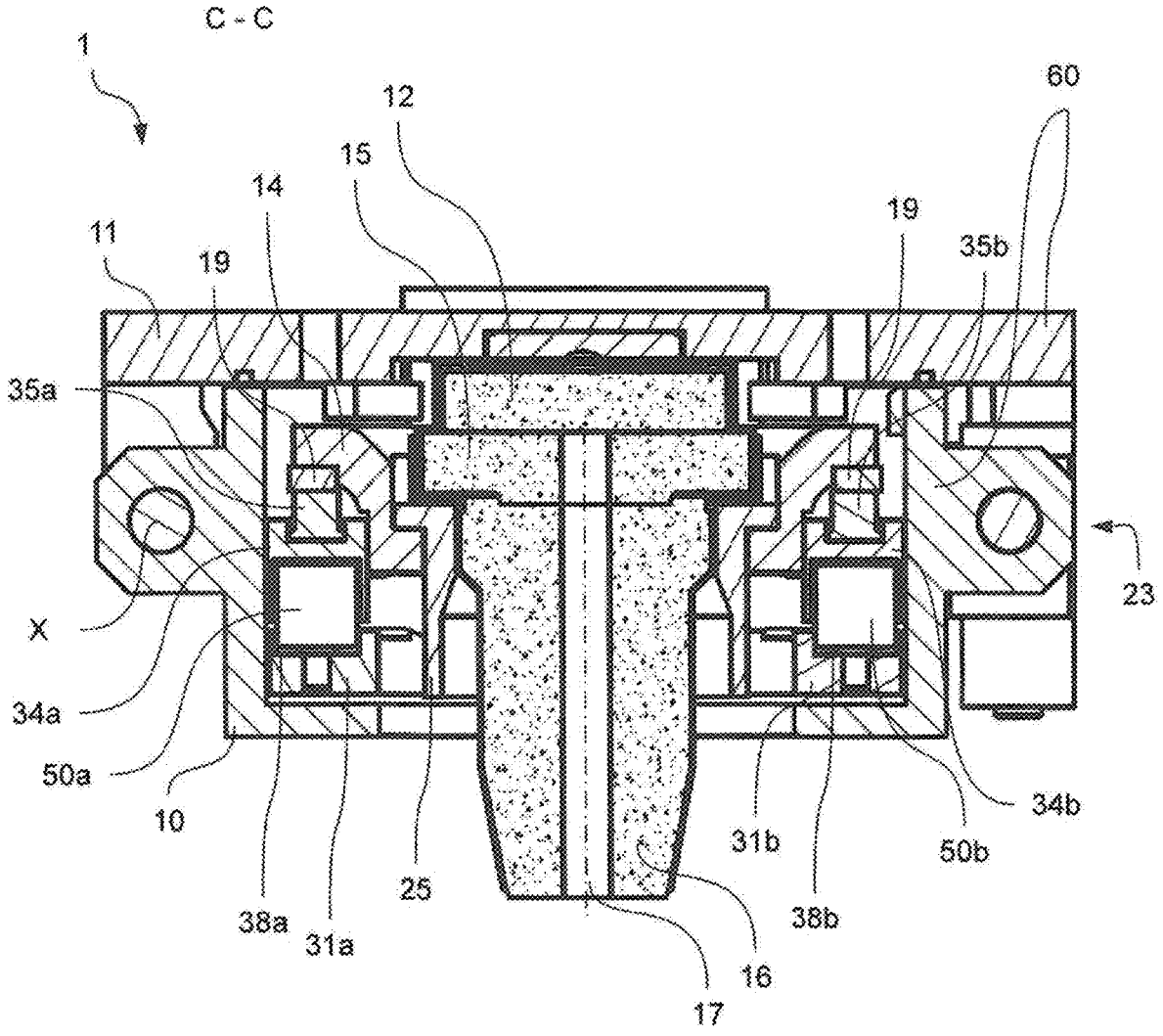
FIG. 5 shows a schematic representation of the embodiment according to FIG. 1 in a sectional plan view along the line C-C in FIG. 2.

In the slide housing 10 a slide frame 14 is arranged so that it can be displaced in a displacement direction V (see double arrow in FIG. 3) relative to the slide housing 10. The slide frame 14 can be moved essentially parallel to the mounting plate 11. Via the lantern 22 and an intermediate piece 21, the slide frame 14 can be connected to a sliding device 24 (not shown), for example to a hydraulic cylinder or sliding hydraulic cylinder with a piston rod for, preferably rotatable, connection to the slide frame 14.

The slide frame 14 comprises a slide plate 15 and a spout 16, which is accommodated in the slide frame 14 via an interchangeable ring 25. Spout 16 extends downward away from the metallurgical vessel or mounting plate 11. The spout 16 and the slide plate 15 can be made in one piece or as separate parts and form a passage opening 17. The slide plate 15 is accommodated in the slide frame 14 or firmly but detachably connected to it.

The sliding device 24 pushes the slide frame 14 into the desired position to open or close the passage opening 13 through the slide plate 15. In the closed position of the slide gate 1 shown in FIG. 3, the slide plate 15 closes the passage opening 13, and when the passage openings 13 and 17 are brought into alignment by a corresponding displacement of the slide frame 14 in an open position, liquid metal can flow from the vessel, through the head plate 12, the slide plate 15 and the spout 16. The slide plate 15 is displaced relative to the head plate 12, with both plates sliding against each other under a contact force or pressure along a common contact surface 20. Ideally, the same contact pressure prevails over the entire contact surface 20.

When closing the slide gate 1, the slide housing 10 is pivoted to the mounting plate 11 and then pressed on, e.g. by a small hydraulic cylinder. This compresses (pre-tensions) the spring elements 50*a*, 50*b* (explained below) to their working dimensions and thus provides the required contact pressure. Now the slide gate 1 is locked via the locking mechanism 23. Slide gate 1 is now in operating condition.

In accordance with the invention, the slide gate 1 comprises a compensating device 30 for compensating the contact pressure of the slide plate 15 against the head plate 12 along the contact surface 20. The contact pressure can be compensated in the transverse direction, for example between the two sides of the slide frame 141 and 142 or the two sides of the slide plate 151 and 152, and/or in the longitudinal direction of the slide gate 1 or the slide frame 14. The compensating device 30 causes the contact pressure in different areas of the contact surface 20 to equalize, ideally compensate. In this way the head plate 12 and the slide plate 15 are loaded as evenly as possible. As a result, the tightness of the slide gate 1 is increased and the wear of the two plates is reduced.

Figure 6:
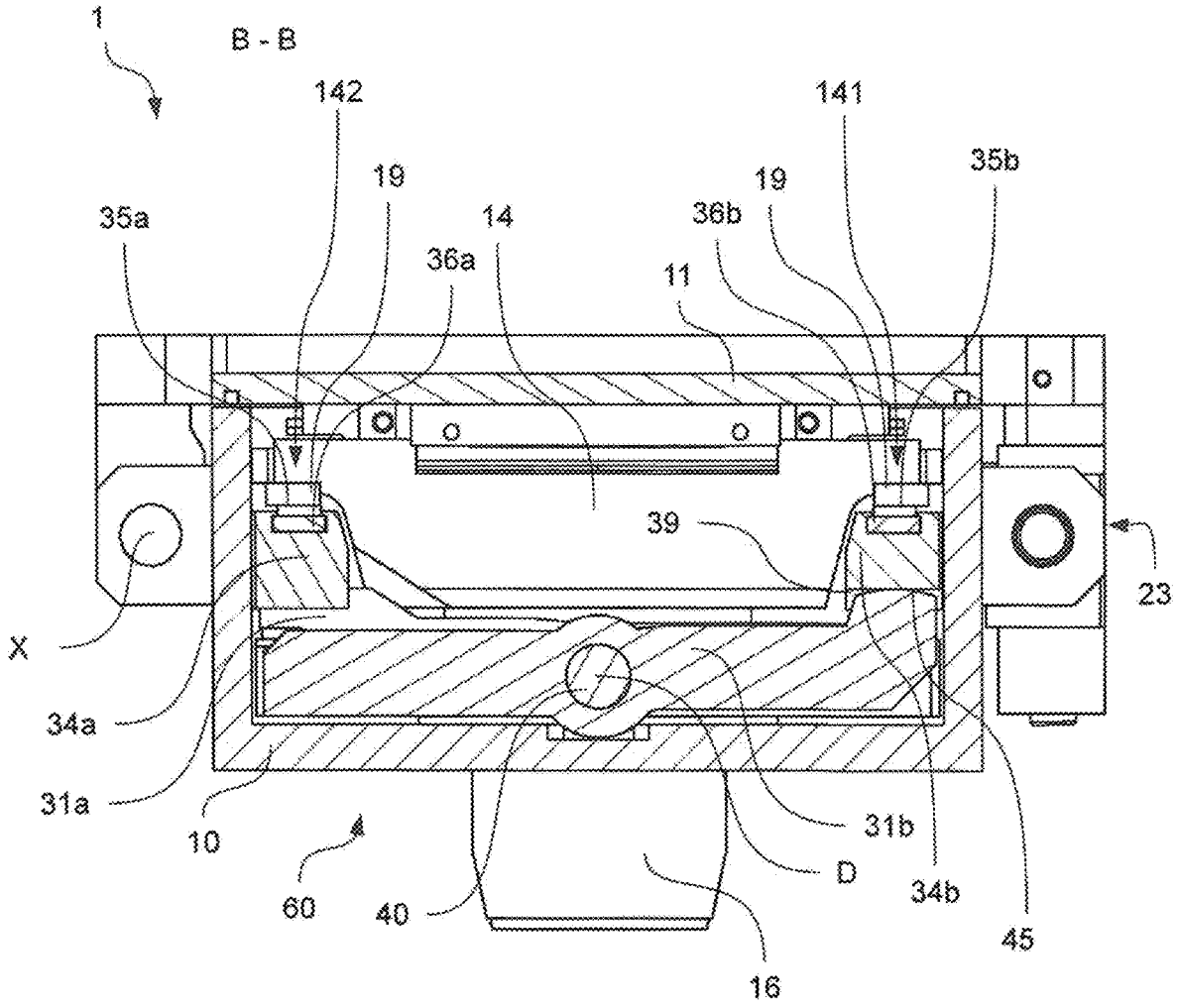
FIG. 6 shows a schematic representation of a further embodiment of a slide gate according to the invention in a sectional plan view corresponding to the view in FIG. 4.
Figure 12:
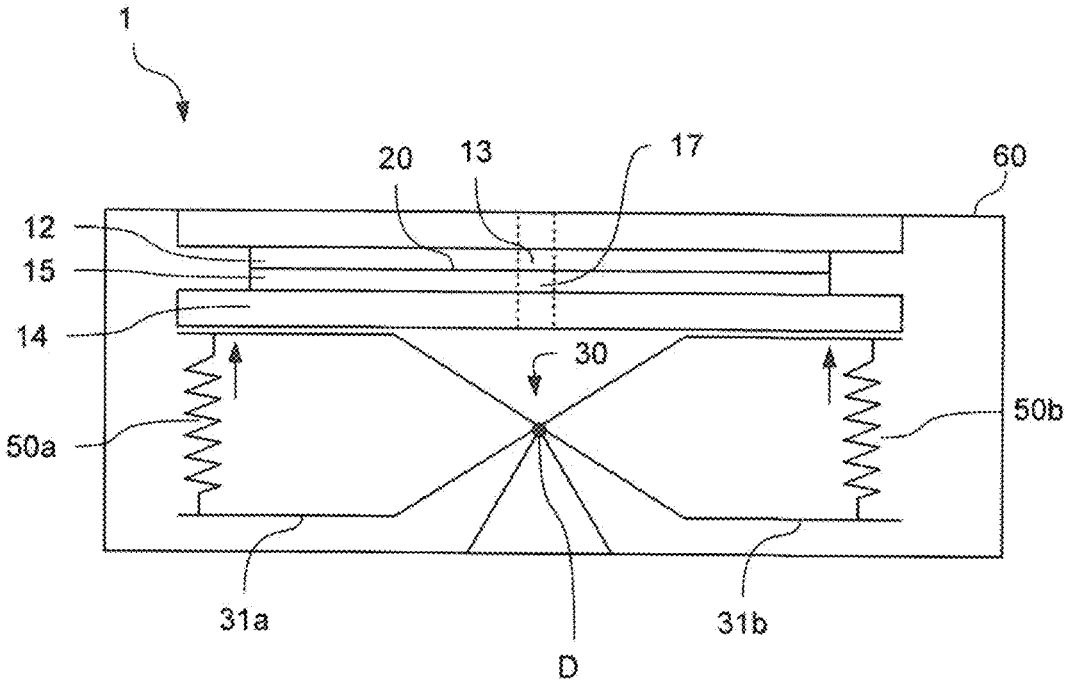
FIG. 12 shows a schematic diagram of the mechanical function of an embodiment of a slide gate according to the invention.

The compensating device 30 of the embodiment shown in FIGS. 1 to 5 is shown separately in FIGS. 8 to 11. The further embodiment shown in FIGS. 6 and 7 deviates from this embodiment in some aspects described below, but otherwise agrees with it. A schematic diagram of the mechanical function of an embodiment of a slide gate 1 with a compensating device 30 according to the invention is shown in FIG. 12.

In the embodiments shown, the compensating device 30 comprises a pair of carrier bodies 31*a*, 31*b*, each of which comprises two laterally arranged carrier arms 32*a*, 32*b*, a carrier web 33*a*, 33*b* connecting the carrier arms 32*a*, 32*b*, and a pressure bar 34*a*, 34*b* placed on bearing surfaces 45 of the carrier arms 32*a*, 32*b* with a sliding strip 35*a*, 35*b* guided therein. The carrier bodies 31*a*, 31*b* each form a carrier frame, in particular an articulated one, but could also each be made in one piece. The carrier bodies 31*a*, 31*b* are made of one or more metallic materials. The carrier bodies 31*a*, 31*b* support the slide frame 14 insofar as the slide frame 14 is supported against the carrier bodies 31*a*, 31*b*. The first carrier body 31*a* and the second carrier body 31*b* are each independent of each other, but are rotatably mounted about a common axis of rotation D in the slide gate housing 60, here in the slide housing 10, via axles 40 in bearing blocks 41, which are firmly connected to the slide gate housing 60. The axis of rotation D extends here along the displacement direction V of the slide frame 14, i.e. in the present case in the longitudinal direction of the slide gate 1. However, it is possible to provide further axes of rotation, in particular perpendicular to the displacement direction V, for example by means of a cardanic bearing, of the slide frame 14 in the slide gate housing 60. In addition, several compensating devices 30, in particular arranged next to each other, can be provided. The two carrier bodies 31*a*, 31*b* are arranged interlocked with each other, wherein the first carrier body 31*a* is arranged on the inside and the second carrier body 31*b* on the outside. In this respect, the first carrier body 31*a* in the direction of the axis of rotation D can be understood as lying outside and the second carrier body 31*b* in the direction of the axis of rotation as lying inside. The carrier arms 32*a*, 32*b* can be formed in a straight, curved or angled manner. The first carrier body 31*a* and the second carrier body 31*b* each have the function of a rocker in that they rotate around the axis of rotation D in a state of equilibrium due to the forces acting on both sides of the carrier arms 32*a* and 32*b*. The carrier bodies 31*a*, 31*b* therefore adjust themselves in such a way that the compensating device 30 is balanced overall under the effect of the contact pressure on the slide frame 14.

The two carrier bodies 31*a*, 31*b* are coupled together by spring elements 50*a*, 50*b* and together form a double rocker. In a plan view (see FIG. 11), the carrier arms 32*a*, 32*b* are arranged in a crossed or interlocking arrangement. The carrier bodies 31*a*, 31*b* are indirectly coupled to the slide frame 14 via the spring elements 50*a*, 50*b*, since a transmission of force from a carrier body 31*a* or 31*b* to the slide frame 14 is influenced or determined by the spring elements 50*a*, 50*b*. The spring elements 50*a*, 50*b* are each supported with one (lower) end in the carrier web 33*a*, 33*b* and with the other (upper) end in the pressure bar 34*b*, 34*a* of the respective other carrier body 31*b* or 31*a*. In this way, forces acting on one of the two sliding strips 35*a* or 35*b* are introduced into the carrier arms 32*a* or 32*b* via the pressure bar 34*a* or 34*b* and transmitted to the other carrier body 31*b* or 31*a* via the carrier web 31*a* or 33*b* with corresponding deformation of the spring elements 50*a* or 50*b*. As a result, the carrier bodies 31*a*, 31*b* each twist in such a way that the forces acting on the sliding strip 35*a*, 35*b* are equalized, ideally compensated completely. If the compensating device 30 is axially symmetrical about the axis of rotation D, especially with centrally mounted carrier arms 32*a*, 32*b*, i.e. lever arms of equal length and the axis of rotation D, the forces are exactly compensated. However, the axis of rotation D need not be arranged centrally, i.e. centered. Depending on length of lever arms, a compensating equilibrium of momentum around axis of rotation D or corresponding distribution of forces between lever arms will be obtained.

It is also conceivable to have embodiments in which only a single rotatably mounted carrier body is provided, which is directly coupled to the slide frame 14 on both sides via one spring element each, which can act as a compression or tension spring. Embodiments with a single rotatably mounted carrier body and only one spring element are also conceivable. Already due to the contact pressure provided by a spring element and the rotatably mounted carrier body of the compensating device, an equilibrium of momentum about the axis of rotation is established, which causes at least a partial compensation or equalization of the contact pressure.

According to the invention, compensation of the contact pressure is achieved in that the spring elements 50*a*, 50*b*, which are subjected to a contact pressure on a first side 141 of the slide frame 14, are not supported in the slide gate housing 60, e.g. on the mounting plate 11 or on the slide housing 10, as is usual in the prior art, but in a carrier body 31*a*, 31*b*, which is rotatably mounted in the slide gate housing 60, and in turn supports itself against slide frame 14 on a second (opposite) side 142. The spring force is thus also used on the opposite side as contact pressure on the slide plate 15 or head plate 12. If a spring element 50*a*, 50*b* fails on one side or provides a reduced spring force, the contact pressure on this side of the compensating device 30 decreases accordingly. As the same force is transmitted to the opposite side via the carrier bodies 31*a*, 31*b*, the contact pressure is also reduced accordingly. The desired effect is thus achieved that the same contact pressure or contact force is applied on both sides 141, 142 of slide frame 14 or on both sides 151, 152 of slide plate 15.

The carrier webs 33*a*, 33*b* are designed here as strips for spring accommodation. In the embodiment shown, four circular cylindrical spring elements 50*a* and 50*b* are inserted in each of the two carrier bodies 31*a*, 31*b* in the carrier web 33*a*, 33*b*, respectively, in suitably formed circular cylindrical spring recesses 38*a*, 38*b* which are supported in circular cylindrical spring recesses 39*b*, 39*a* suitably formed on the underside of the pressure bar in 34*b*, 34*a*. However, a different number for each carrier body 31*a* or 31*b* as well as different types of spring elements 50*a*, 50*b* for the two or one carrier body 31*a*, 31*b* can be used. For example, four spring elements 50*a* could be provided for a first carrier body 31*a* and two spring elements 50*b* for a second carrier body 31*b*. In the described embodiment example with four spring elements 50*a* or 50*b* on each side, these four spring elements 50*a*, 50*b* on each side act directly on the slide frame 14 and further on the slide plate 15 and, by transmitting the supporting force via the carrier bodies 31*a*, 31*b*, also on the respective opposite side. For cost reasons, for example, the number of spring elements 50*a*, 50*b* can be reduced. A higher number of spring elements 50*a*, 50*b* can reduce their load and extend their durability. Spring elements 50*a*, 50*b* with different spring hardnesses can be used or combined with each other. Here the spring elements 50*a*, 50*b* are thermodynamic springs. Mechanical springs, such as coil springs or disc springs, can also be used as spring elements 50*a*, 50*b*.

The pressure bars 34*a*, 34*b* rest on bearing surfaces 45 of the carrier arms 32*a*, 32*b*. By means of a recess in the cross-section, the pressure bars 34A, 34*b* form support surfaces 42 on both sides towards their ends, via which the pressure bars 34*a*, 34*b* are supported axially against the inner sides of the carrier arms 31*a*, 31*b*. The bearing surfaces 45 are rounded so that the pressure bars 34*a*, 34*b* can roll off when the carrier arms 32*a*, 32*b* are twisted. Such an articulated bearing ensures that the slide frame 14 rests flat on the compensating device 30, here on the sliding strips 35*a*, 35*b*, to ensure good sliding properties.

The pressure bars 34*a*, 34*b* each form a rail 47, e.g. with a rectangular or dovetailed profile, into which a sliding strip 35*a* or 35*b* is inserted. Sliding strips 35*a*, 35*b* can have a sliding coating on their upper side. The sliding strip 35*a*, 35*b* is axially secured by flat pieces 36*a*, 36*b* fixed in the rail 47. Sliding elements 19 are attached to the underside of the slide frame 14. The slide frame 14 rests on the sliding strips 35*a*, 35*b*. The slide frame 14 can be moved in sliding direction V in relation to the compensating device 30. In the present embodiment, the slide frame 14 is of sliding design. However, it could also be mounted on the compensating device 30, e.g. by means of intermediate rollers on the underside of the slide frame or on the top of the pressure bars 34*a*, 34*b*. The sliding strips 35*a*, 35*b* can slide along the underside of the sliding frame 14 perpendicular to the axis of rotation D, i.e. in the transverse direction of the compensating device 30 or of the slide gate 1, e.g. when a carrier body 31*a*, 31*b* is twisted.

Figure 10:
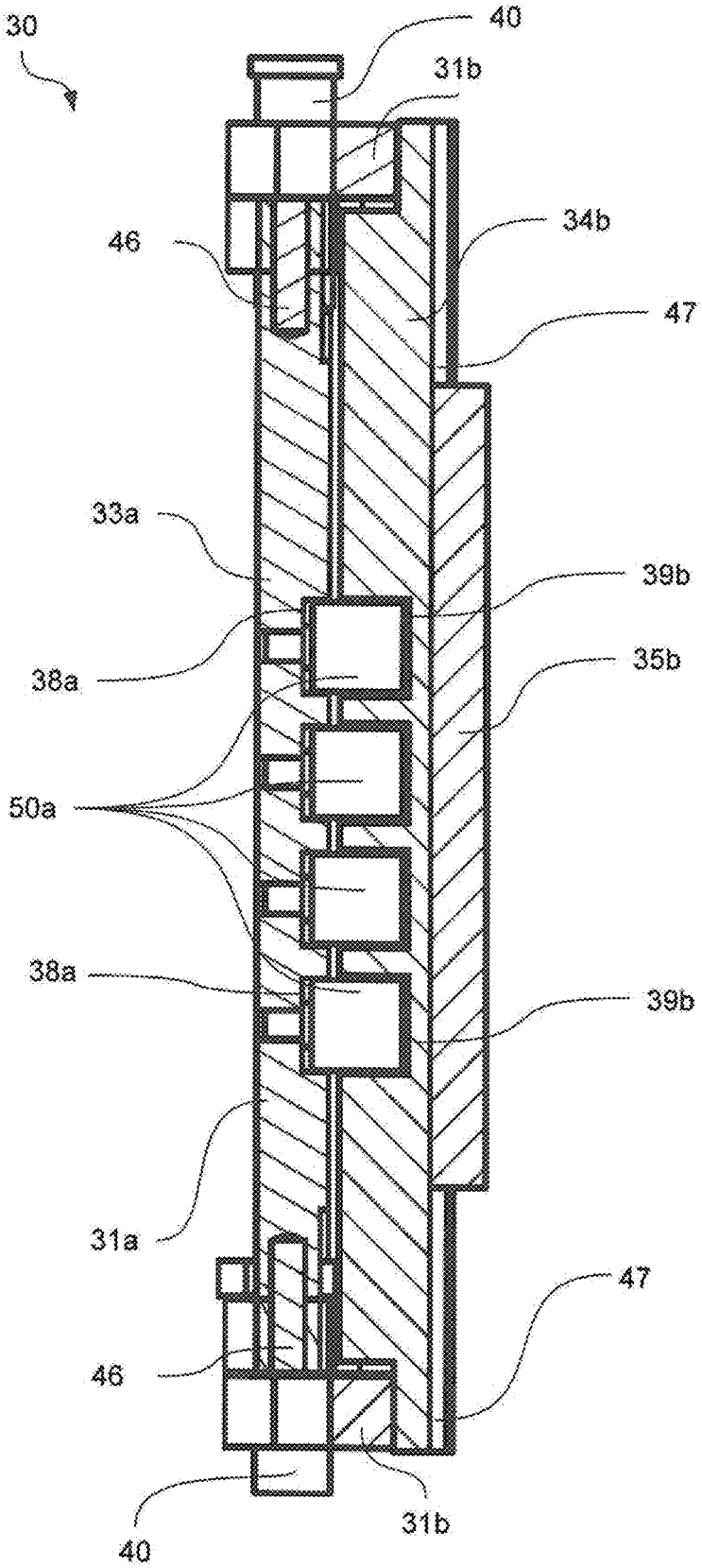
FIG. 10 shows a schematic representation of the compensating device according to FIG. 8 in a sectional side view.
Figure 11:
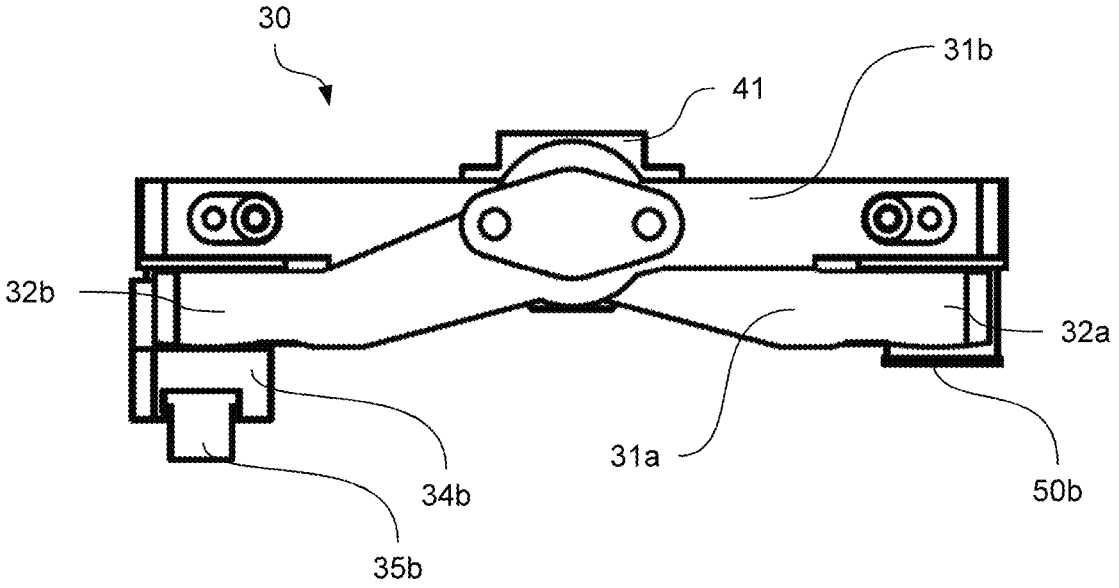
FIG. 11 shows a schematic representation of the compensating device according to FIG. 8 in a plan view.

In the embodiment shown in FIG. 10, the carrier webs 33*a*, 33*b* are connected to the carrier arms 32*a*, 32*b* via cylindrical bolts 46 in a rotatable, but not tiltable manner.

Figure 7:
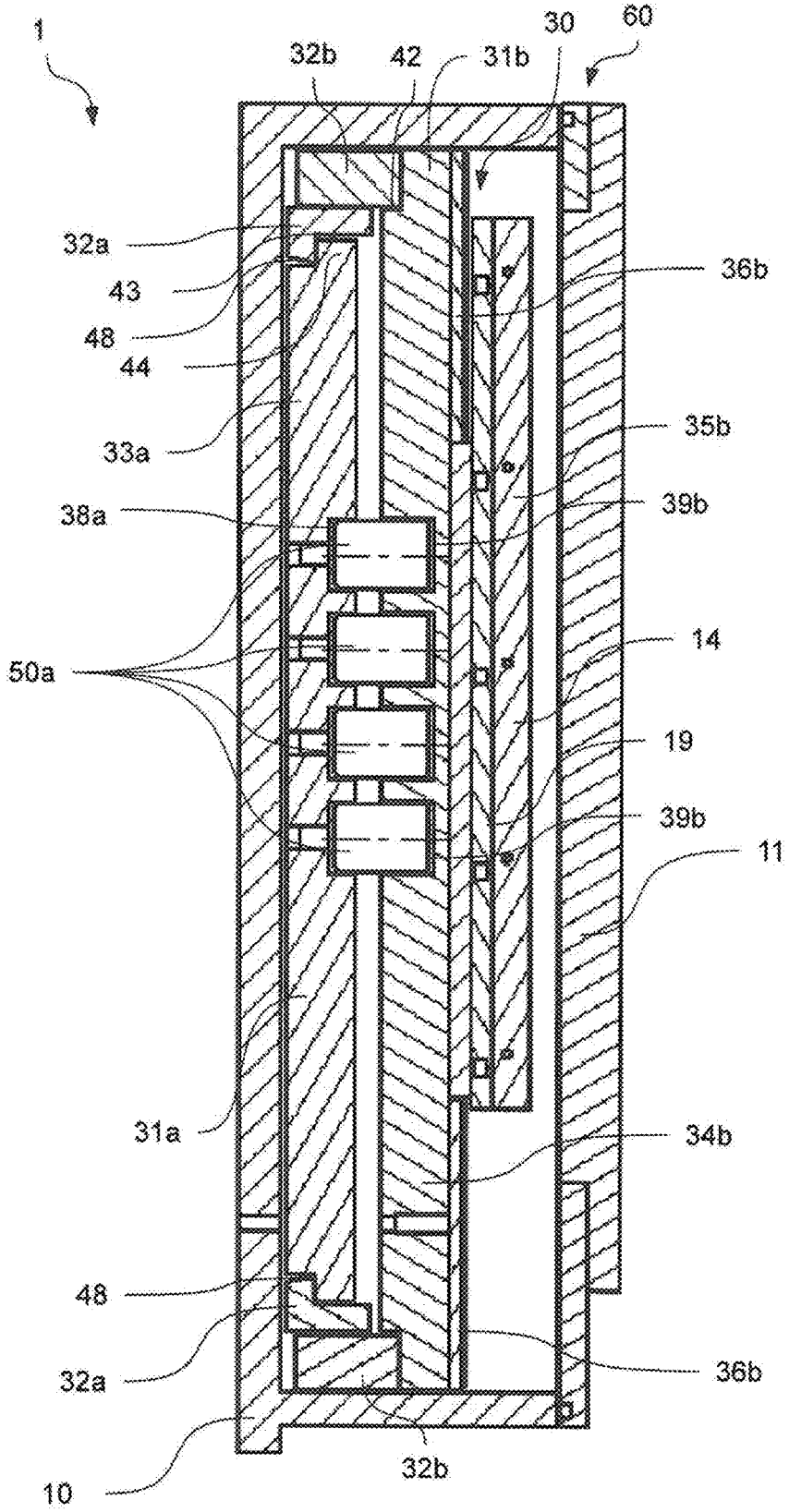
FIG. 7 shows a schematic representation of the embodiment according to FIG. 6 in a 90° rotated sectional side view along the Line A-A.
Figure 8:
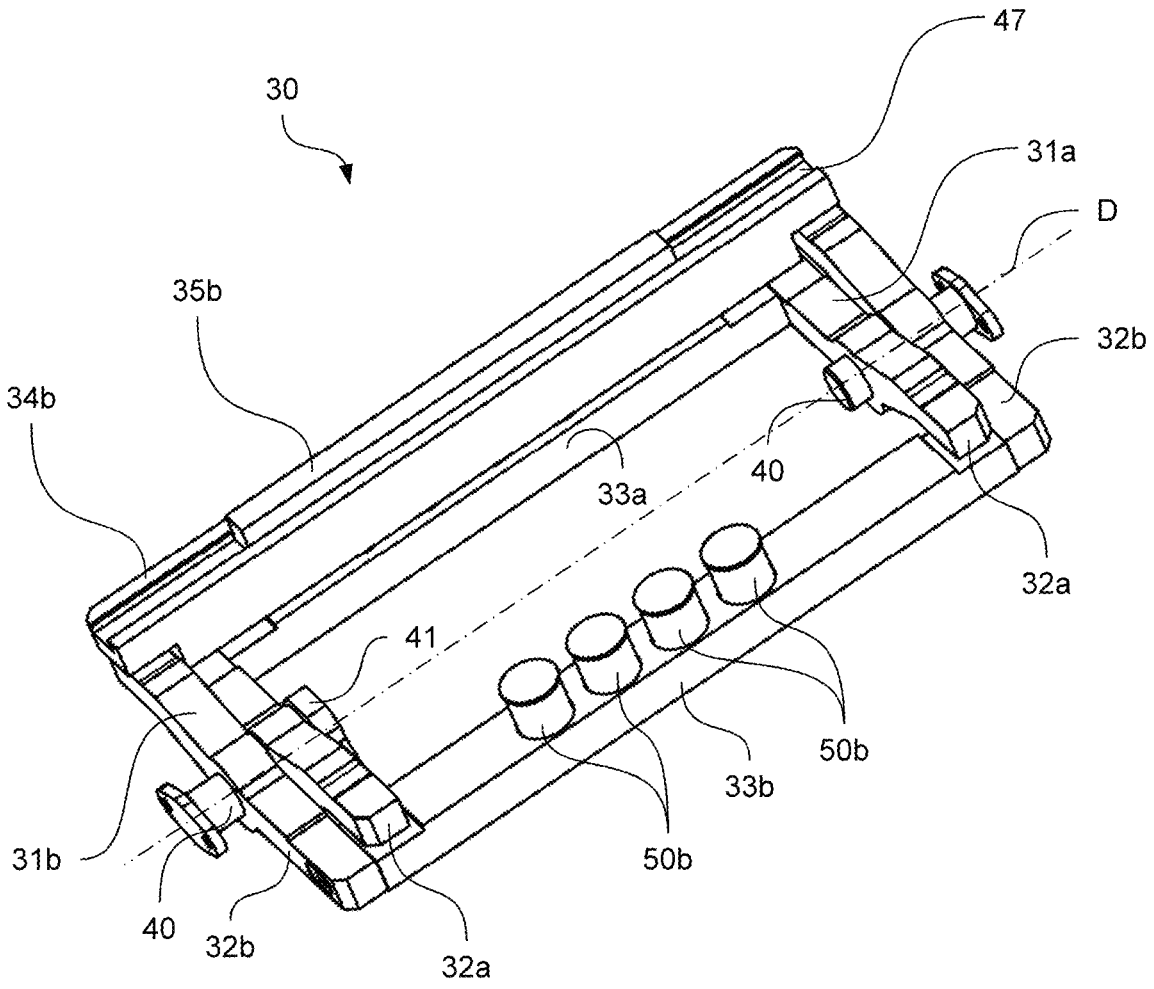
FIG. 8 shows a schematic partial representation of an embodiment of a compensating device of a slide gate according to the invention in a perspective view.
Figure 9:
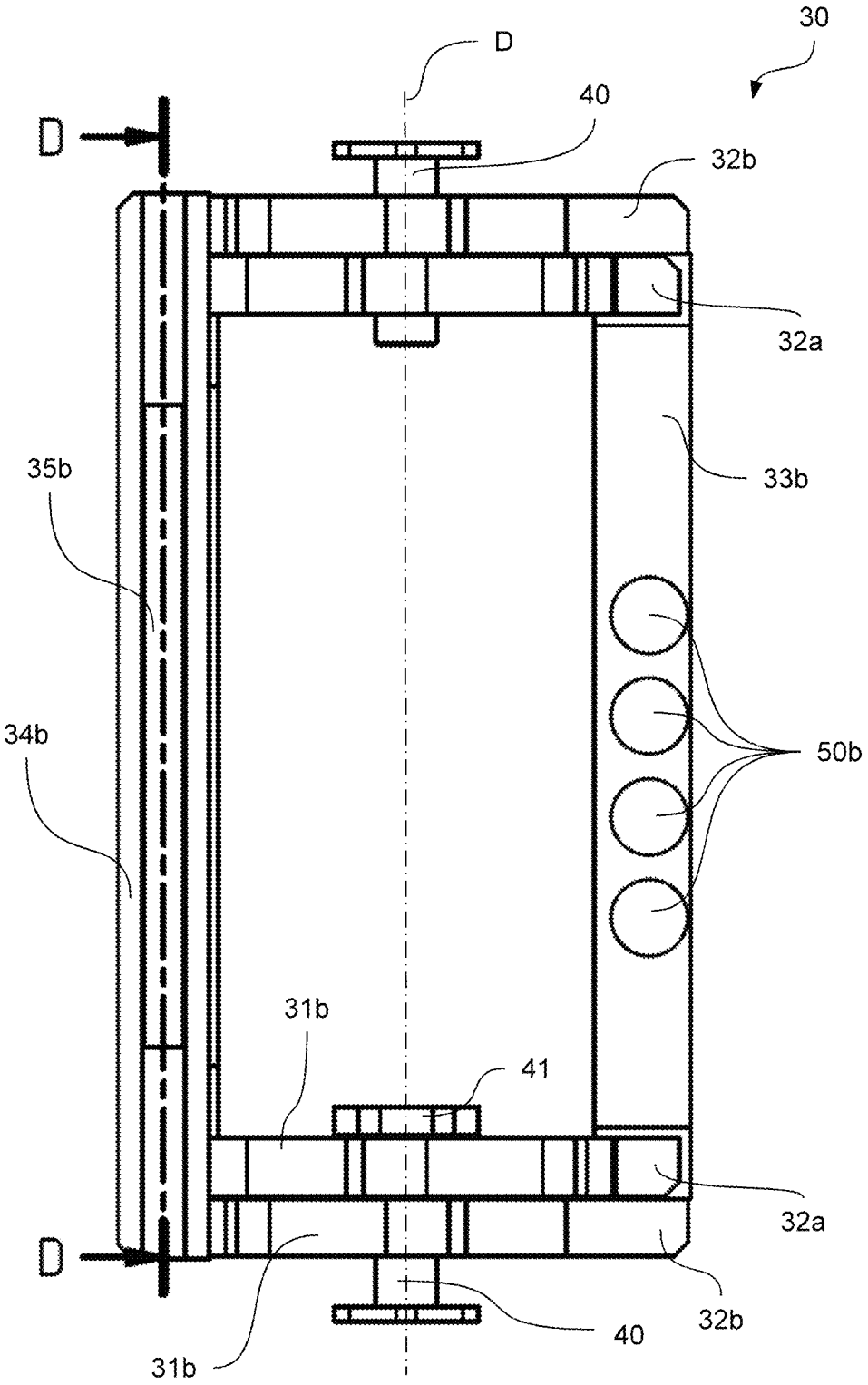
FIG. 9 shows a schematic representation of the compensating device as shown in FIG. 8 in a rear view.

In the embodiment shown in FIG. 7, the carrier webs 33*a*, 33*b* are suspended via lateral pins 44 in matching recesses 43 in the carrier arms 32*a*, 32*b*. The pins 44 preferably have a partially rounded profile, e.g. a semicircular profile, optionally with beveled sections. Thus the carrier web 33*a*, 33*b* is connected to the carrier arms 32*a*, 32*b* both rotatably and tiltably or mounted therein. The carrier arms 32*a*, 32*b* have a chamfer 48 on their inside in order to avoid obstructing the tilting of the carrier web 33*a*, 33*b*.

A slide gate 1 according to the invention is reliable and can be operated safely. The contact pressure between the slide plate 15 and the head plate 12 is as even as possible, especially in the event of failure of individual spring elements 50*a*, 50*b*.

It should be noted at this point that all the aspects of the invention described above are considered, on their own and in any combination, in particular the details shown in the drawings, to be essential to the invention. The person skilled in the art is familiar with modifications thereof.

LIST OF REFERENCE NUMERALS

1 Slide gate
10 Slide housing
11 Mounting plate
12 Head plate
13 Passage opening
14 Slide frame
15 Slide plate
16 Spout
17 Passage opening
19 Sliding element
20 Contact surface
21 Intermediate piece
22 Lantern
23 Locking mechanism
24 Sliding device
25 Interchangeable ring
26 Seal
27 Wear ring
30 Compensating device
31*a*, 31*b* Carrier body
32*a*, 32*b* Carrier arm
33*a*, 33*b* Carrier web
34*a*, 34*b* Pressure bar
35*a*, 35*b* Sliding strip
36*a*, 36*b* Flat piece
38*a*, 38*b* Spring recess
39*a*, 39*b* Spring recess
40 Axle
41 Bearing block
42 Axial support surface
43 Recess

44 Pin
45 Bearing surface
46 Bolt
47 Rail
48 Chamfer
50*a*, 50*b* Spring element
60 Slide gate housing
151 First side of the slide plate
152 Second side of the slide plate
141 First side of the slide frame
142 Second side of the slide frame
X Pivot axis
V Displacement direction
D Axis of rotation
M Central axis

The invention claimed is:

1. A slide gate for a metallurgical vessel, comprising
a slide gate housing attachable to a metallurgical vessel,
a head plate which is in the slide gate housing and has a passage opening for a metallic melt,
a slide frame, which is mounted in the slide gate housing to be displaceable in a displacement direction relative to the head plate,
a slide plate which is in the slide frame and has a passage opening, and
a compensating device configured to compensate contact pressure of the slide plate against the head plate and arranged between the slide gate housing and the slide frame, wherein the compensating device comprises:
at least one carrier body, which is mounted in the slide gate housing to be rotatable about at least one axis of rotation, and
at least one spring element, via which the carrier body is coupled to the slide frame,
wherein the carrier body supports itself against the slide frame on both sides of the slide frame, the sides of the slide frame being opposite with respect to the at least one axis of rotation.

2. The slide gate according to claim 1, wherein
the slide gate housing comprises a mounting plate for fixing the slide gate to a metallurgical vessel and a slide housing for guiding the slide frame,
wherein the slide housing is connected to the mounting plate and the compensating device is between the slide housing and the slide frame.

3. The slide gate according to claim 2, wherein
the slide frame rests on the carrier body, wherein the slide frame is guided by the slide housing in the displacement direction.

4. The slide gate according to claim 1, wherein
the at least one axis of rotation of the carrier body extends parallel to the displacement direction of the slide frame.

5. The slide gate according to claim 1, wherein
the compensating device comprises at least one pair of carrier bodies rotatably mounted in the slide gate housing,
wherein a first side of the slide frame rests on a first carrier body and a second side of the slide frame rests on a second carrier body.

6. The slide gate according to claim 1, wherein
the at least one carrier body comprises a first carrier body and a second carrier body that are coupled to one another via spring elements.

7. The slide gate according to claim 2, wherein
a first carrier body and a second carrier body are mounted about a common axis of rotation in the slide housing.

8. The slide gate according to claim 1, wherein
the at least one axis of rotation of the at least one carrier body extends parallel to a central axis of the head plate.

9. The slide gate according to claim 1, wherein
the at least one carrier body comprises a first carrier body and a second carrier body rotatably mounted in the slide gate housing, and
the first carrier body is closer, in the direction of the at least one axis of rotation to the head plate than the second carrier body and the second carrier body is outside of the first carrier body in the direction of the at least one axis of rotation.

10. The slide gate according to claim 1, wherein
the same number and/or the same type of spring elements is on both sides of the compensating device.

11. The slide gate according to claim 1, wherein
the at least one carrier body comprises a first carrier body and a second carrier body rotatably mounted in the slide gate housing, and
the first carrier body and the second carrier body are mounted in the slide gate housing to be rotatable about two axes of rotation extending at right angles to one another.

12. The slide gate according to claim 1, wherein
the slide gate is a three-plate slide gate, wherein a spout plate is between the compensating device and the slide frame.

13. The slide gate according to claim 1, wherein the at least one spring element couples the at least one carrier body to the slide frame to transmit contact pressure force to the slide frame.

14. A slide gate for a metallurgical vessel, comprising
a slide gate housing attachable to a metallurgical vessel,
a head plate which is in the slide gate housing and has a passage opening for a metallic melt,
a slide frame, which is mounted in the slide gate housing to be displaceable in a displacement direction relative to the head plate,
a slide plate which is in the slide frame and has a passage opening, and
a compensating device configured to compensate contact pressure of the slide plate against the head plate and arranged between the slide gate housing and the slide frame, wherein the compensating device comprises:
at least one carrier body, which is mounted in the slide gate housing to be rotatable about at least one axis of rotation, and
at least one spring element, via which the carrier body is coupled to the slide frame, wherein
the at least one carrier body has a pressure bar which is mounted in an articulated manner on or in the carrier body.

15. The slide gate according to claim 14, wherein
a sliding strip for supporting the slide frame is in the pressure bar.

16. The slide gate according to claim 14, wherein
the at least one carrier body comprises a first carrier body and a second carrier body rotatably mounted in the slide gate housing, and
spring elements are supported in a carrier web of the first carrier body or the second carrier body and the pressure bar associated with the second carrier body or the first carrier body.

17. The slide gate according to claim 14, wherein the at least one carrier body has bearing surfaces for the pressure bar.

18. A slide gate for a metallurgical vessel, comprising a slide gate housing attachable to a metallurgical vessel, a head plate which is in the slide gate housing and has a passage opening for a metallic melt, a slide frame, which is mounted in the slide gate housing to be displaceable in a displacement direction relative to the head plate, a slide plate which is in the slide frame and has a passage opening, and a compensating device configured to compensate contact pressure of the slide plate against the head plate and arranged between the slide gate housing and the slide frame, wherein the compensating device comprises:

at least one carrier body, which is mounted in the slide gate housing to be rotatable about at least one axis of rotation, and at least one spring element, via which the carrier body is coupled to the slide frame, wherein the at least one carrier body comprises two carrier arms and a carrier web which connects the carrier arms to one another.

19. The slide gate according to claim 18, wherein the carrier web is rotatably and/or tiltably mounted in the carrier body.

20. A slide gate for a metallurgical vessel, comprising a slide gate housing attachable to a metallurgical vessel, a head plate which is in the slide gate housing and has a passage opening for a metallic melt, a slide frame, which is mounted in the slide gate housing to be displaceable in a displacement direction relative to the head plate, a slide plate which is in the slide frame and has a passage opening, and a compensating device configured to compensate contact pressure of the slide plate against the head plate and arranged between the slide gate housing and the slide frame, wherein the compensating device comprises:

at least one carrier body, which is mounted in the slide gate housing to be rotatable about at least one axis of rotation, and at least one spring element, via which the carrier body is coupled to the slide frame, wherein a sliding device is rotatably connectable to the slide frame for displacing the slide frame in the displacement direction.

* * * * *